US011464300B2

(12) United States Patent
Lewis et al.

(10) Patent No.: US 11,464,300 B2
(45) Date of Patent: Oct. 11, 2022

(54) DISPLAY ATTACHMENT

(71) Applicant: Arthur Snyder, Los Angeles, CA (US)

(72) Inventors: Stephen Arthur Lewis, Pacific Palisades, CA (US); Arthur Snyder, Los Angeles, CA (US)

(73) Assignee: Arthur Snyder, Los Angeles, CA (US)

( * ) Notice: Subject to any disclaimer, the term of this patent is extended or adjusted under 35 U.S.C. 154(b) by 0 days.

(21) Appl. No.: 17/495,723

(22) Filed: Oct. 6, 2021

(65) Prior Publication Data

US 2022/0022609 A1 Jan. 27, 2022

Related U.S. Application Data

(63) Continuation-in-part of application No. 29/798,178, filed on Jul. 6, 2021, which is a continuation-in-part of application No. 29/705,041, filed on Sep. 9, 2019, now Pat. No. Des. 925,658, which is a continuation-in-part of application No. 15/593,664, filed on May 12, 2017, now Pat. No. 10,420,383.

(60) Provisional application No. 62/335,183, filed on May 12, 2016.

(51) Int. Cl.
*A44C 1/00* (2006.01)

(52) U.S. Cl.
CPC ..... *A44C 1/00* (2013.01)

(58) Field of Classification Search
CPC ..... A44C 1/00; Y10T 24/13; Y10T 24/1394
See application file for complete search history.

(56) References Cited

U.S. PATENT DOCUMENTS

| | | | | |
|---|---|---|---|---|
| 1,567,406 | A | 12/1925 | Wilke | |
| 5,624,319 | A * | 4/1997 | Golczyk | B21D 53/24 470/21 |
| 5,713,707 | A * | 2/1998 | Gagnon | F16B 37/041 411/112 |
| 5,795,248 | A * | 8/1998 | Giglio | A63B 57/00 473/406 |
| 5,979,028 | A | 11/1999 | Hicks | |
| 6,105,294 | A | 8/2000 | Goodfellow | |
| 6,287,064 | B1 | 9/2001 | Jhumra | |
| 6,321,418 | B1 | 11/2001 | Halleck | |
| 6,455,128 | B1 | 9/2002 | Moon | |
| 6,694,526 | B1 * | 2/2004 | Tate | A42B 1/24 2/209.12 |
| 7,325,335 | B2 | 2/2008 | Cook-Euell | |
| 7,444,724 | B1 | 11/2008 | Peder | |

(Continued)

*Primary Examiner* — Robert Sandy
*Assistant Examiner* — Rowland Do
(74) *Attorney, Agent, or Firm* — Loeb & Loeb LLP

(57) ABSTRACT

A display attachment can be attached to apparel such as, but not limited to, shoes or shirts and can also be attached to other objects such as, but not limited to, backpacks, notebooks, or clipboards in order to display interchangeable adornments, messages, and logos. The display attachment includes a design display, a display clip, and an attachment mechanism. The design display is a display that includes a design which may be, but is not limited to, adornments, messages, or logos. The display clip allows the display attachment to be attached onto apparel or other objects. The attachment mechanism may be any mechanism that allows the design display to be attached to the display clip. Thus, the user can remove the design display when desired in order to attach another design display to the display clip.

19 Claims, 6 Drawing Sheets

(56) References Cited

U.S. PATENT DOCUMENTS

| | | | | |
|---|---|---|---|---|
| 7,654,783 | B2 * | 2/2010 | Giraud | F16B 37/041 411/174 |
| 7,999,818 | B2 | 8/2011 | Mamoudis | |
| 8,266,769 | B2 | 9/2012 | Murray | |
| 10,420,383 | B2 | 9/2019 | Lewis | |
| D925,658 | S | 7/2021 | Lewis | |
| 2004/0202523 | A1 * | 10/2004 | Csik | F16B 37/043 411/112 |
| 2005/0129481 | A1 * | 6/2005 | Wimmer | F16B 37/041 411/175 |
| 2006/0260153 | A1 | 11/2006 | White | |
| 2007/0273520 | A1 * | 11/2007 | Chamandy | G06K 19/07758 340/572.1 |
| 2009/0056177 | A1 | 3/2009 | Mallozzi | |
| 2011/0265363 | A1 | 11/2011 | Oliver-Collins | |
| 2011/0296728 | A1 | 12/2011 | Bolt | |
| 2021/0128463 | A1 | 5/2021 | Farra | |

* cited by examiner

DISPLAY ATTACHMENT

The current application is a continuation-in-part (CIP) application of the U.S. design application serial number 29/798,178 filed on Jul. 6, 2021. The U.S. design application 29/798,178 claims a priority to the U.S. design application serial number 29/705,041 filed on Sep. 9, 2019. The U.S. design application 29/705,041 claims a priority to a U.S. non-provisional application Ser. No. 15/593,664 filed on May 12, 2017. The U.S. non-provisional application Ser. No. 15/593,664 claims a priority to the U.S. provisional patent application Ser. No. 62/335,183 filed on May 12, 2016.

FIELD OF THE INVENTION

The present invention relates generally to apparel and accessory attachments. More specifically, the present invention is a display attachment that can be attached to apparel or other objects to display interchangeable adornments, messages, and logos.

BACKGROUND OF THE INVENTION

Individuals enjoy decorating their apparel such as shoes or shirts and other objects such as backpacks, notebooks, or clipboards. The most common methods of decorating apparel and objects involve the use of stickers, buttons, or clips. These stickers, buttons, and clips include a design, and if the individual wants another design, the individual must purchase a brand-new sticker, button, or clip. Moreover, a sticker can either fall-off due to the lack of effectiveness of the adhesive over time and a button damages the apparel or other object. There exists a need for an invention that can be easily attached to apparel or other objects while allowing a user to interchange designs without having to purchase a brand-new decorative attachment.

The present invention solves the problem by providing a display attachment that can be attached to apparel or other objects to display interchangeable adornments, messages, and logos. The display attachment includes a design display and a display clip. The design display includes a design such as any adornment, message, or logo. The display clip allows the display attachment to be attached to apparel or other objects through a clip arm mechanism. Further, the design display can be attached to the display clip through an attachment mechanism. This allows a user to fully secure the design display to the display clip or remove the design display in order to attach another design display when desired.

DETAIL DESCRIPTIONS OF THE INVENTION

All illustrations of the drawings are for the purpose of describing selected versions of the present invention and are not intended to limit the scope of the present invention.

In reference to FIGS. 1 through 6, the present invention is a display attachment that can be primarily attached to apparel such as, but not limited to, shoes or shirts but can also be attached to other objects such as, but not limited to, backpacks, clipboards, or notebooks in order to display interchangeable adornments, messages, and logos. The present invention comprises a design display 1, a display clip 4, and an attachment mechanism 17. The design display 1 is a display that includes a design which may be, but is not limited to, adornments, messages, or logos. The display clip 4 allows the present invention to be attached onto apparel or other objects. The attachment mechanism 17 may be any mechanism that allows the design display 1 to be attached to the display clip 4. Thus, the user can remove the design display 1 when desired in order to attach another design display 1 to the display clip 4.

Figure 1:
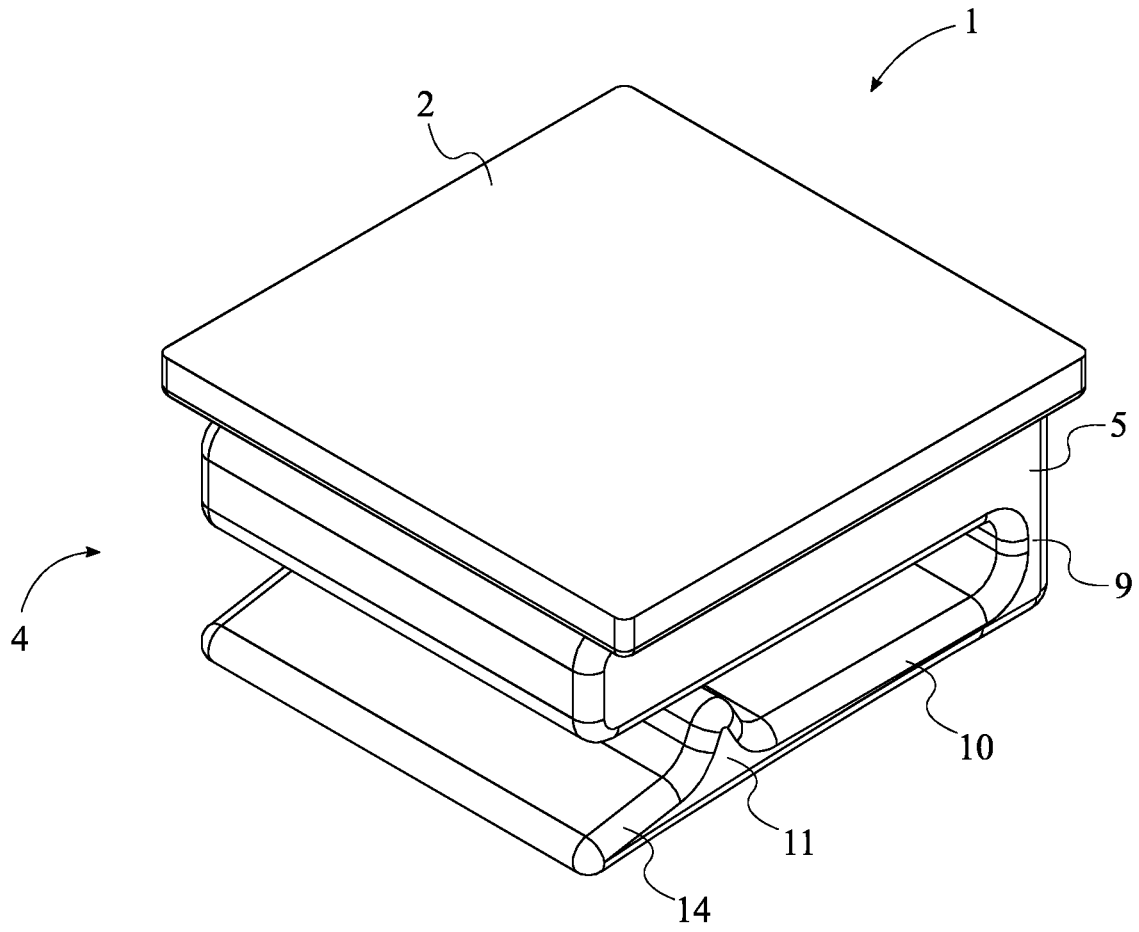
FIG. 1 is a front-top perspective view of the present invention.
Figure 2:
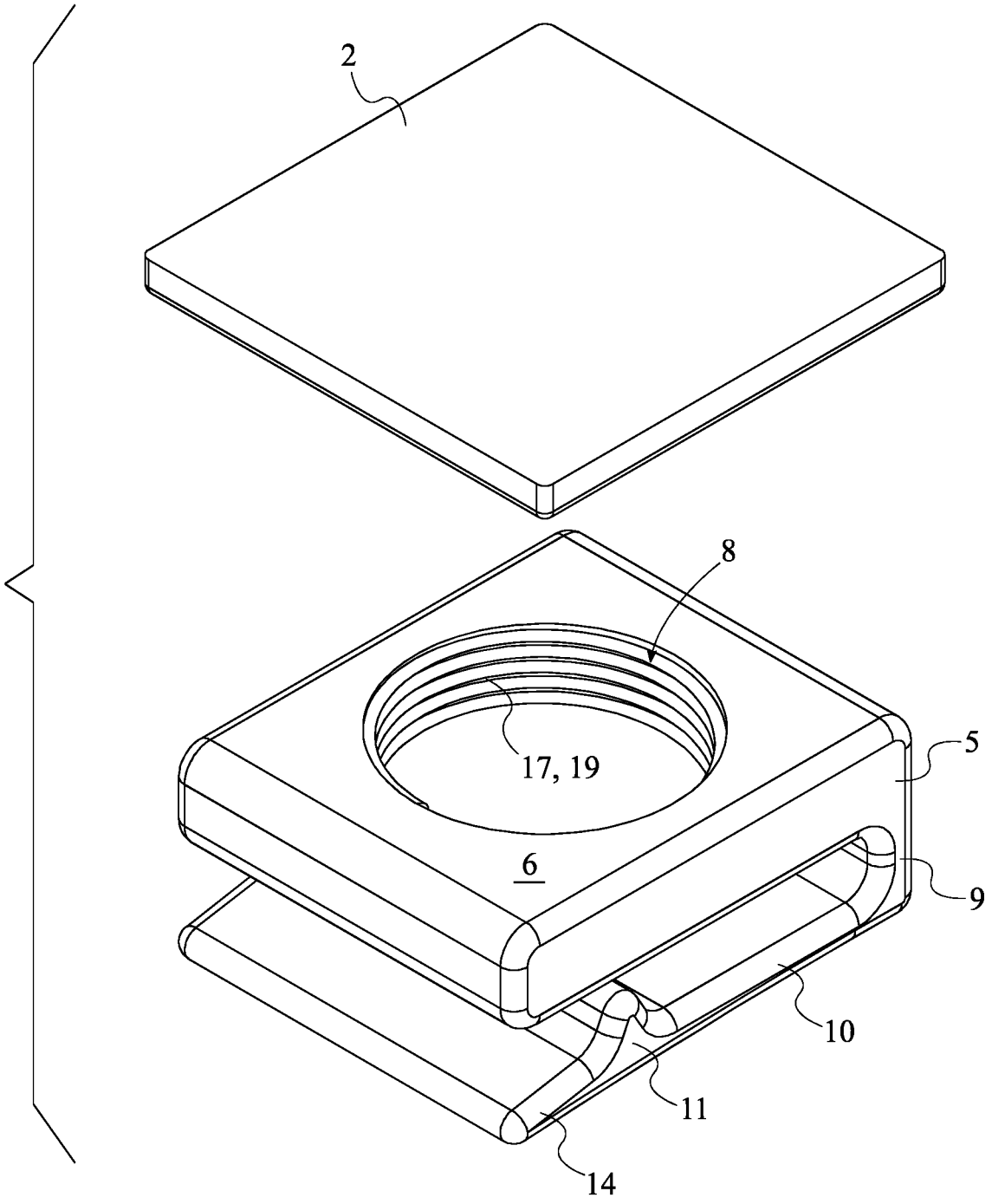
FIG. 2 is an exploded front-top perspective view of the present invention.
Figure 3:
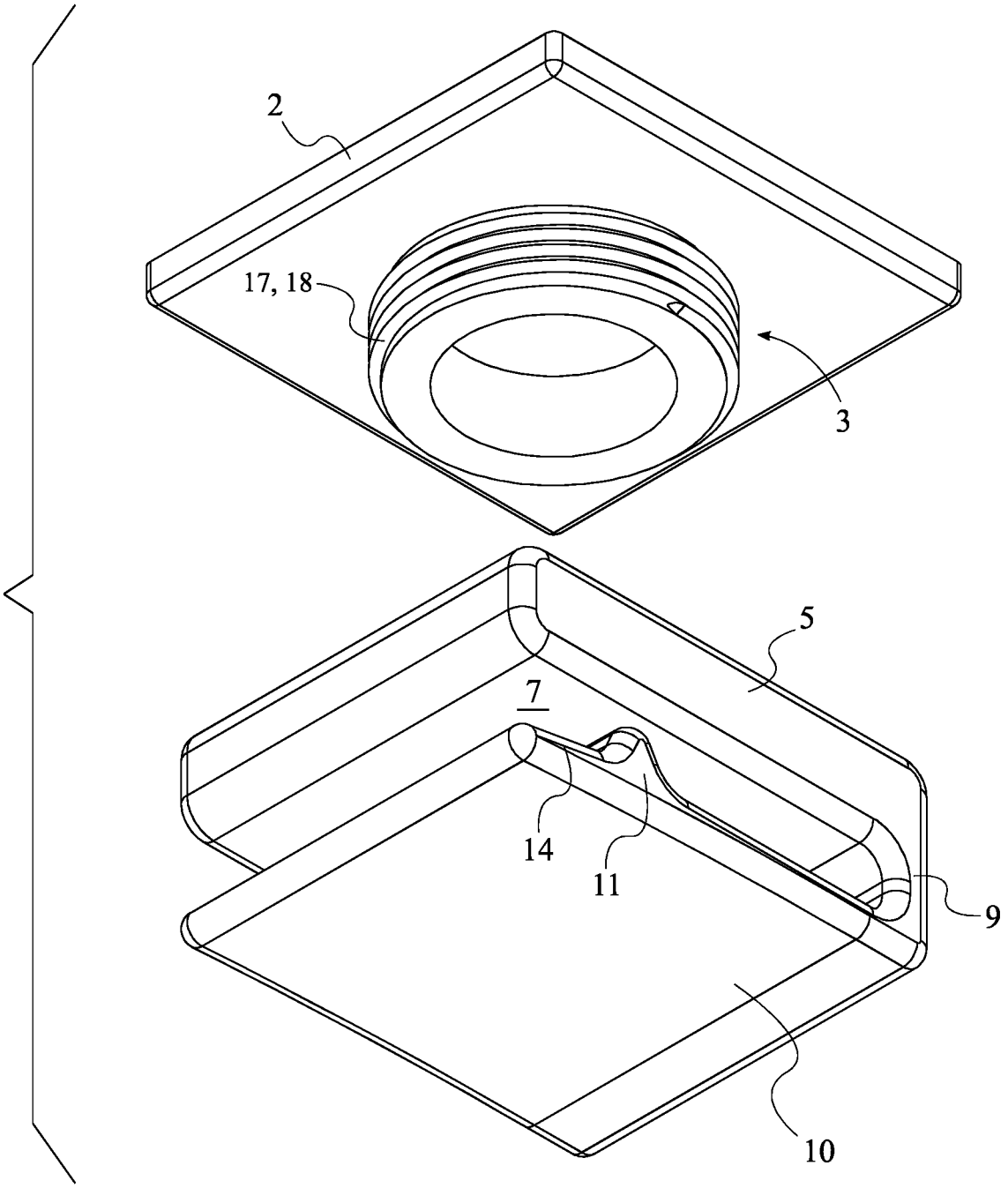
FIG. 3 is an exploded front-bottom perspective view of the present invention.
Figure 5:
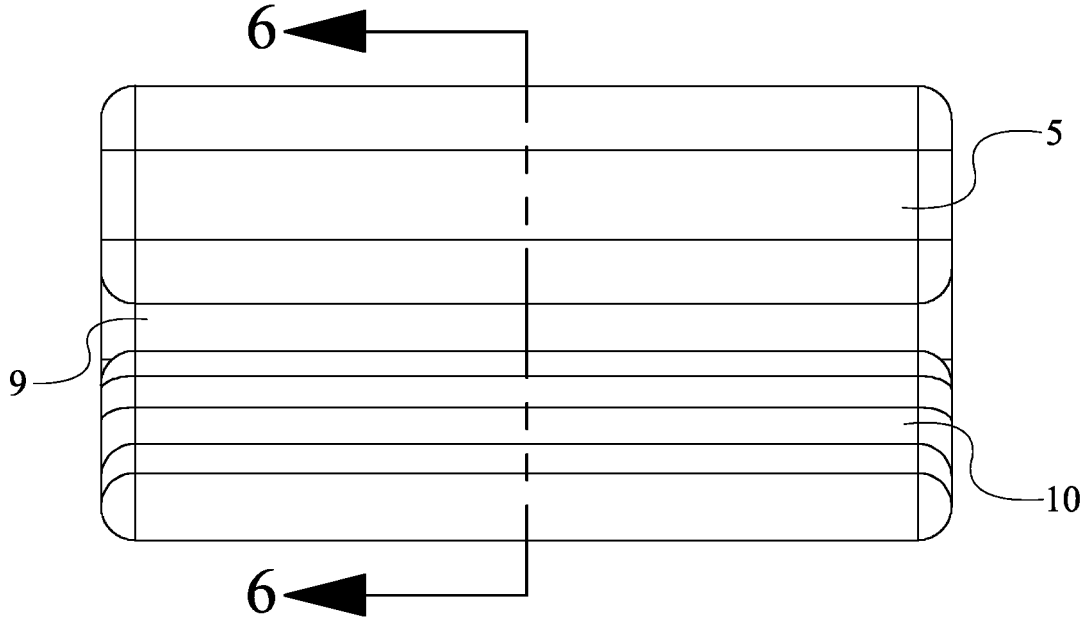
FIG. 5 is a front view of the present invention.

The general configuration of the aforementioned components allows the present invention to be attached to apparel or other objects in order to display interchangeable adornments, messages, and logos. With reference to FIGS. 2 and 3, the design display 1 comprises a display plate 2 and a display post 3. The display plate 2 may be any shape or size but is preferably a rectangular plate. Further, the display post 3 is preferably a cylindrical protrusion that can be inserted into a post receptacle 8 of the display clip 4. The display post 3 is connected normal onto the display plate 2. Thus, the display post 3 is perpendicular to a front plate face and a rear plate face of the display plate 2. Moreover, the display post 3 is specifically connected normal onto the rear plate face of the display plate 2 and is centrally positioned to the display plate 2. The front plate face of the display plate 2 includes the design which may be any adornment, message, or logo. The display clip 4 comprises a flat base 5, the post receptacle 8, a clip web 9, and a clip arm 10 and the flat base 5 comprises a first base face 6 and a second base face 7. The post receptacle 8 traverses into the flat base 5 from the first base face 6. In more detail, the post receptacle 8 is a cavity of the display clip 4 designed to receive the display post 3. Further, the post receptacle 8 is centrally positioned to the first base face 6. The following arrangements define the structure of the display clip 4. With reference to FIGS. 1 and 5, the clip web 9 is peripherally positioned to the flat base 5, the clip web 9 is terminally positioned to clip arm 10, the clip arm 10 is positioned parallel and offset from the second base face 7, and the clip web 9 is connected in between the second base face 7 and the clip arm 10. These arrangements allow the display clip 4 to be attached to apparel or other object by securing a portion of an apparel item or a portion of an object in between the flat base 5 and the clip arm 10 and against the clip web 9. Furthermore, the display post 3 is attached into the post receptacle 8 by the attachment mechanism 17 in order to fully secure the display post 3 within the post receptacle 8 and to allow the removal of the display post 3 when desired.

In the preferred embodiment and with reference to FIGS. 2 and 3, the attachment mechanism 17 is preferably a threaded fastening mechanism and thus, comprises a male threading 18 and a female threading 19. The male threading 18 is laterally connected around the display post 3 and the female threading 19 is laterally connected within the post receptacle 8. These arrangements position the male threading 18 to effectively contact the female threading 19 when the display post 3 is inserted into the post receptacle 8. Further, the male threading 18 is engaged to the female threading 19 in order to fully secure the display post 3 within the post receptacle 8.

Figure 4:
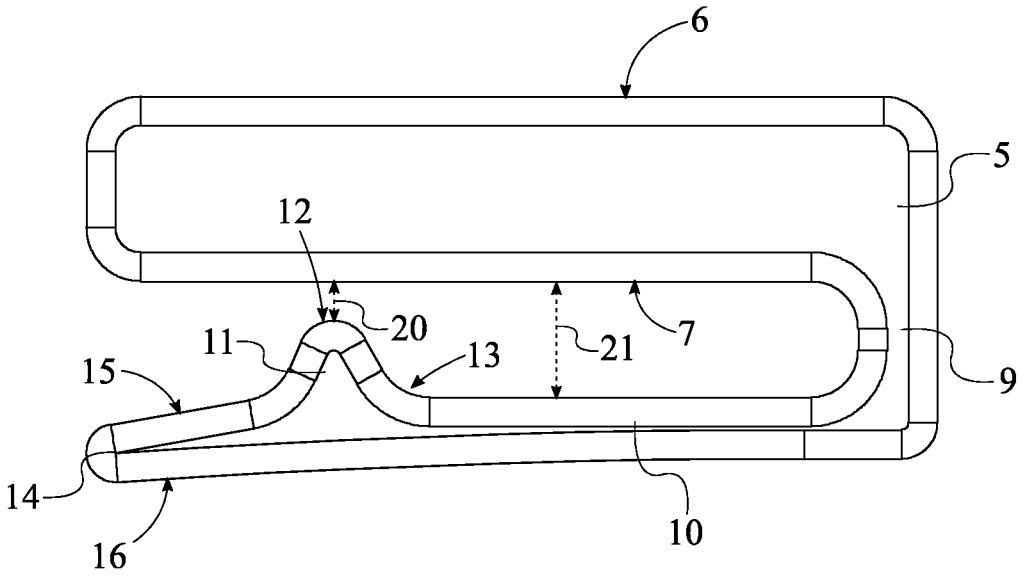
FIG. 4 is a right-side view of the present invention.

In order to prevent the display clip 4 from accidentally being removed from apparel or other objects and with reference to FIG. 4, the display clip 4 further comprises a clip ridge 11. The clip ridge 11 is an elevated portion of the display clip 4. The clip ridge 11 comprises a peak ridge end 12 and a base ridge end 13. The base ridge end 13 is terminally connected to the clip arm 10, opposite the clip web 9. In more detail, the clip ridge 11 is structurally part of the display clip 4 and is positioned to ensure a portion of an apparel item or a portion of an object is maintained in between the clip ridge 11 and the clip web 9. Further, the peak ridge end 12 is oriented towards the second base face 7 in order to ensure that apparel or other objects are maintained in between the flat base 5 and the clip arm 10. Moreover, a first clearance 20 is between the second base face 7 and the peak ridge end 12 and a second clearance 21 is between the second base face 7 and the clip arm 10. A ratio between the first clearance 20 and the second clearance 21 ranges from 0.3 to 0.4. This arrangement allows apparel or other objects to easily slide through the second clearance 21 but prevents apparel or other objects from accidentally sliding through the first clearance 20 and therefore, prevents the display clip 4 from accidentally being removed from apparel of other objects.

In order to allow apparel or other objects to be easily slid in between the flat base 5 and the clip arm 10 without damaging the apparel or other objects and with reference to FIG. 4, the display clip 4 further comprises a clip wedge 14. The clip wedge 14 comprises a slanted face 15 and a continuous face 16. The slanted face 15 and the continuous face 16 are positioned opposite to each other the clip wedge 14. In more detail, the slanted face 15 is positioned at the top of the clip arm 10 in order to allow apparel or other objects to be slid in between the flat base 5 and the clip arm 10. Further, the clip wedge 14 is terminally connected to the clip arm 10, opposite the clip web 9. Thus, the clip wedge 14 is structurally part of the display clip 4. The slanted face 15 is oriented towards the second base face 7. This arrangement provides a ramp for apparel or other objects to slide in between the flat base 5 and the clip arm 10 in a manner that prevents damage to the apparel or other object. Further, the continuous face 16 is oriented away from the second base face 7. This arrangement allows a user to easily bend the clip arm 10 downwards in order to fit apparel or other objects through the second clearance 21.

Figure 6:
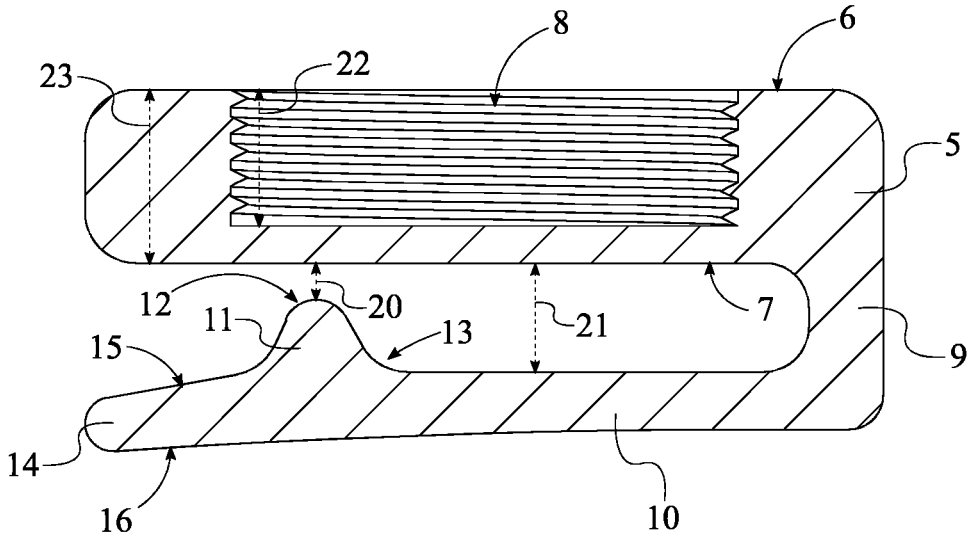
FIG. 6 is a cross-section view of the present invention taken along line 6-6 from FIG. 5.

In order for the display post 3 to be fully secured within the post receptacle 8 and with reference to FIG. 6, a ratio between the depth 22 of the post receptacle 8 and a thickness 23 of the flat base 5 ranges from 0.55 to 0.65. Thus, the post receptacle 8 is designed to receive the entire length of the display post 3. In more detail, the display post 3 can be fully threaded into the post receptacle 8 by the attachment mechanism 17.

Although the invention has been explained in relation to its preferred embodiment, it is to be understood that many other possible modifications and variations can be made without departing from the spirit and scope of the invention as hereinafter claimed.

What is claimed is:

1. A display attachment comprising:

a design display;

a display clip;

an attachment mechanism comprising a male threading and a female threading;

the design display comprising a display plate and a display post;

the display clip comprising a flat base, a post receptacle, a clip web, and a clip arm;

the flat base comprising a first base face and a second base face;

the display post being connected normal onto the display plate;

the post receptacle traversing into the flat base from the first base face and not passing through to the second base face with the display plate being in contact with the first base face;

the clip web being peripherally positioned to the flat base;

the clip web being terminally positioned to the clip arm;

the clip arm being positioned parallel and offset from the second base face;

the clip web being connected in between the second base face and the clip arm; and the display post being directly attached into the post receptacle by the attachment mechanism.

2. The display attachment as claimed in claim 1 comprising;

the male threading being laterally connected around the display post;

the female threading being laterally connected within the post receptacle; and the male threading being engaged to the female threading.

3. The display attachment as claimed in claim 1 comprising:

the display clip further comprising a clip ridge;

the clip ridge comprising a peak ridge end and a base ridge end;

the base ridge end being terminally connected to the clip arm, opposite the clip web; and the peak ridge end being oriented towards the second base face.

4. The display attachment as claimed in claim 3 comprising:

a first clearance being between the second base face and the peak ridge end;

a second clearance being between the second base face to the clip arm; and a ratio between the first clearance and the second clearance ranging from 0.3 to 0.4.

5. The display attachment as claimed in claim 1 comprising:

the display clip further comprising a clip wedge;

the clip wedge comprising a slanted face and a continuous face;

the slanted face and the continuous face being positioned opposite to each other about the clip wedge;

the clip wedge being terminally connected to the clip arm, opposite the clip web;

the slanted face being oriented towards the second base face; and the continuous face being oriented away from the second base face.

6. The display attachment as claimed in claim 1 comprising:

the post receptacle being centrally positioned to the first base face.

7. The display attachment as claimed in claim 1 comprising:

the display post being centrally positioned to the display plate.

8. The display attachment as claimed in claim 1, wherein a ratio between a depth of the post receptacle and a thickness of the flat base ranges from 0.55 to 0.65.

9. A display attachment comprising:

a design display;

a display clip;

an attachment mechanism comprising a male threading and a female threading;

the design display comprising a display plate and a display post;

the display clip comprising a flat base, a post receptacle, a clip web, a clip arm; and a clip ridge;

the flat base comprising a first base face and a second base face;

the clip ridge comprising a peak ridge end and a base ridge end;

the display post being connected normal onto the display plate;

the post receptacle traversing into the flat base from the first base face and not passing through to the second base face with the display plate being in contact with the first base face;

the clip web being peripherally positioned to the flat base;

the clip web being terminally positioned to the clip arm;

the clip arm being positioned parallel and offset from the second base face;

the clip web being connected in between the second base face and the clip arm;

the display post being directly attached into the post receptacle by the attachment mechanism;

the male threading being laterally connected around the display post;

the female threading being laterally connected within the post receptacle;

the male threading being engaged to the female threading;

the base ridge end being terminally connected to the clip arm, opposite the clip web; and the peak ridge end being oriented towards the second base face.

10. The display attachment as claimed in claim 9 comprising:

a first clearance being between the second base face and the peak ridge end;

a second clearance being between the second base face and clip arm; and a ratio between the first clearance and the second clearance ranging from 0.3 to 0.4.

11. The display attachment as claimed in claim 9 comprising:

the display clip further comprising a clip wedge;

the clip wedge comprising a slanted face and a continuous face;

the slanted face and the continuous face being positioned opposite to each other about the clip wedge;

the clip wedge being terminally connected to the clip arm, opposite the clip web;

the slanted face being oriented towards the second base face; and the continuous face being oriented away from the second base face.

12. The display attachment as claimed in claim 9 comprising:

the post receptacle being centrally positioned to the first base face.

13. The display attachment as claimed in claim 9 comprising:

the display post being centrally positioned to the display plate.

14. The display attachment as claimed in claim 9, wherein a ratio between a depth of the post receptacle and a thickness of the flat base rangers from 0.55 to 0.65.

15. A display attachment comprising:

a design display;

a display clip;

an attachment mechanism comprising a male threading and a female threading;

the design display comprising a display plate and a display post wherein the display post being connected normal onto the display;

the display clip comprising a flat base, a post receptacle, a clip web, a clip arm, a clip ridge, and a clip wedge;

the flat base comprising a first base face and a second base face;

the clip ridge comprising a peak ridge end and a base ridge end;

the clip wedge comprising a slanted face and a continuous face;

the post receptacle traversing in to the flat base from the first base face and not passing through to the second base face with the display plate being in contact with the first base face;

the clip web being peripherally positioned to the flat base;

the clip web being terminally positioned to the clip arm;

the clip arm being positioned parallel and offset from the second base face;

the clip web being connected in between the second base face and the clip arm; and the display post being attached directly into the post receptacle by the attachment mechanism;

the male threading being laterally connected around the display post;

the female threading being laterally connected within the post receptacle;

the male threading being engaged to the female threading;

the base ridge end being terminally connected to the clip arm, opposite the clip web;

the peak ridge end being oriented towards the second base face;

the slanted face and the continuous face being positioned opposite to each other about the clip wedge;

the clip wedge being terminally connected to the clip arm, opposite the clip web;

the slanted face being oriented towards the second base face; and the continuous face being oriented away from the second base face.

16. The display attachment as claimed in claim 15 comprising:

a first clearance being between the second base face and the peak ridge end;

a second clearance being between the second base face and the clip arm; and a ratio between the first clearance and the second clearance ranging from 0.3 to 0.4.

17. The display attachment as claimed in claim 15 comprising:

the post receptacle being centrally positioned to be the first base face.

18. The display attachment as claimed in claim 15 comprising:

The display post being centrally positioned to the display plate.

19. The display attachment as claimed in claim 15, wherein a ratio between a depth of the post receptacle and a thickness of the flat base ranges from 0.55 to 0.65.

* * * * *